US006052649A

United States Patent [19]

Goldman et al.

[11] Patent Number: 6,052,649

[45] Date of Patent: Apr. 18, 2000

[54] METHOD AND APPARATUS FOR QUANTIFYING SHALE PLASTICITY FROM WELL LOGS

[75] Inventors: William A. Goldman; Kambiz Arab, both of Houston; Gary E. Weaver, Conroe, all of Tex.

[73] Assignee: Dresser Industries, Inc., Dallas, Tex.

[21] Appl. No.: 09/081,483

[22] Filed: May 18, 1998

[51] Int. Cl.[7] ..... G06F 19/00

[52] U.S. Cl. ..... 702/11

[58] Field of Search ..... 702/6, 7, 8, 9

[56] References Cited

U.S. PATENT DOCUMENTS

| | | | |
|---|---|---|---|
| 4,096,385 | 6/1978 | Marett | 702/8 |
| 4,903,527 | 2/1990 | Herron | 702/8 |
| 5,205,164 | 4/1993 | Steiger et al. | 702/9 |
| 5,330,016 | 7/1994 | Paske et al. . | |
| 5,704,436 | 1/1998 | Smith et al. . | |
| 5,767,399 | 6/1998 | Smith et al. . | |
| 5,794,720 | 8/1998 | Smith et al. . | |

OTHER PUBLICATIONS

Z. Bassiouni, "Theory, Measurement, And Interpretation Of Well Logs", Society of Petroleum Engineers (SPE) textbook series, Richardson, Texas 1994.

E.L. Bigelow, "Introduction To Wireline Log Analysis", Western Atlas International, Houston, 1992.

E.R. Crain, "The Log Analysis Handbook, Volume One: Quantative Log Analysis Methods", PennWell, Tulsa, OK 1986.

J.T. Dewan, "Essentials Of Modern Open–Hole Log Interpretation", PennWell, Tulsa, OK 1983.

M.H. Rider, "The Geological Interpretation Of Well Logs", Gulf Publishing, Houston, 1996.

"Schlumberger Log Interpretation Principles/Applications", Schlumberger, Houston, 1991.

M.G. Prammer, E.D. Bouton, J.C. Gardner, J.S. Coates, G.R. Chandler, R.N. and M.N. Miller, "Measurements Of Clay–Bound Water And Total Porosity By Magnetic Resonance Logging", SPE paper 36522, 1996.

Eric Van Oort, "Physico–Chemical Stabilization Of Shales", SPE paper 37623, 1996.

L. Smith, F.K Mody, A. Hale and N. Romslo, "Successful Field Application Of An Electro–Negative 'Coating' To Reduce Bit Balling Tendencies in Water Besed Mud", SPE/IADC paper 35110, 1996.

W.A. Goldman and L.M. Smith, "Method For Quantifying The Lithologic Composition Of Formations Surrounding Earth Boreholes", pending U.S. patent application filed by Security DBS.

*Primary Examiner*—Donald E. McElheny, Jr.
*Attorney, Agent, or Firm*—Haynes and Boone, L.L.P.

[57] ABSTRACT

Shale plasticity in a geological formation is quantified by the steps of measuring a shale volume of the formation, measuring a shale composition of the formation, measuring a shale water content of the formation, and determining a measure of shale plasticity of the formation in response to the measured shale volume, shale composition, and shale water content according to a shale plasticity model. An apparatus for quantifying shale plasticity is disclosed also.

37 Claims, 3 Drawing Sheets

METHOD AND APPARATUS FOR QUANTIFYING SHALE PLASTICITY FROM WELL LOGS

BACKGROUND OF THE INVENTION

1. Field of the Invention

The present invention is related to methods and apparatus for determining shale plasticity, and more particularly, to methods and apparatus for estimating the occurrence of petroleum drilling conditions likely to cause balling up of a drill bit during drilling of a wellbore.

2. Discussion of the Related Art

Determining clay volume, type, and water content from well logs is common practice today. However, such measurements have historically been made Independently of one another with the primary purpose of characterizing the geology of petroleum reservoirs. Although the methods measure clay parameters individually, the methods have not previously been combined to provide a measure of shale plasticity.

A measure of shale plasticity is thus desired for use in petroleum drilling operations to identify potential plastic shale zones.

SUMMARY OF TIE INVENTION

According to a present embodiment, a method of quantifying shale plasticity in a geological formation includes the steps of measuring a shale volume, measuring a shale composition, measuring a shale water content, and determining a measure of shale plasticity in response to the measured shale volume, shale composition, and shale water content according to a shale plasticity model.

In one embodiment, measuring the shale volume includes extracting a measure of shale volume from a well log. Shale volume may be measured from a gamma ray log, a spectral gamma ray log, or a neutron-density log.

Measuring shale composition includes obtaining a measure of shale composition by one of several methods. Shale composition can be measured using a thorium/potassium ratio obtained from a spectral gamma ray log. Alternatively, shale composition may be measured using a cation exchange capacity (CEC). CEC can be (a) directly determined from chemical analysis of one or more shale samples obtained from the formation, (b) indirectly determined from a gamma ray log, (c) indirectly determined from a spectral gamma ray log, or (d) indirectly determined from a neutron-density log. Lastly, measuring the shale water content includes extracting a measure of water content from a well log. Such a well log may include either a nuclear magnetic resonance log or a neutron-density log.

Still further, in another alternate embodiment, determining the measure of shale plasticity from the measurements of shale volume, shale composition, and shale water content according to the shale plasticity model includes: (i) identifying a shale zone from the measured shale volume, the shale zone being characterized by a clay content greater than a prescribed threshold and indicative of possible plastic behavior, (ii) identifying a shale type from the measured shale composition, the shale type being characterized by smectite and indicative of possible plastic behavior, and (iii) identifying the shale water content being characterized by a plastic zone and indicative of possible plastic behavior.

Still further, providing a measure of overall shale plasticity includes taking a weighted average of three parameters representative of the shale zone, shale type, and shale water content. Weighting factors are used. The weighting factors are for biasing the average towards those parameters that exert a greater influence on shale plasticity in the given geology. Calibrating the weighting factors is accomplished by comparing the overall shale plasticity measure predicted from the shale plasticity model to a reference shale plasticity measured using a chemical analysis of shale samples taken from the geological formation.

In another embodiment, the measures of shale volume, shale type, and shale water content are derived from well logs of a logged wellbore.

A plasticity quantifying apparatus and drilling system are disclosed also.

BRIEF DESCRIPTION OF THE DRAWINGS

The foregoing and other teachings and advantages of the present invention will become more apparent upon a detailed description of the best mode for carrying out the invention as rendered below. In the description to follow, reference will be made to the accompanying drawings, where like reference numerals are used to identify like parts in the various views and in which.

DETAILED DESCRIPTION

Figure 1:
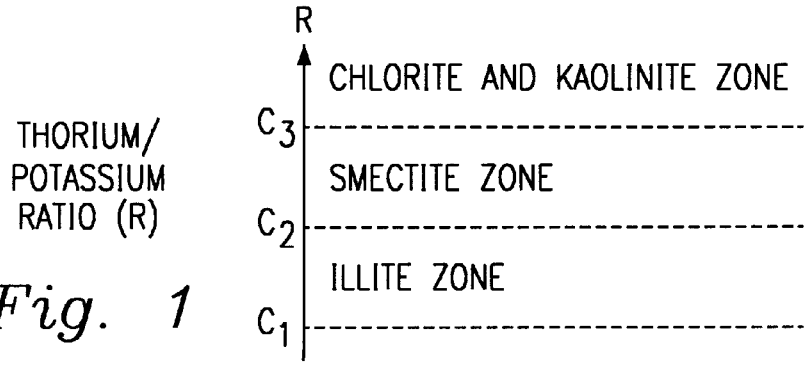
FIG. 1 illustrates a thorium/potassium ratio line having valves for delineating various clay types by zones.

The present embodiment provides a method and apparatus for modeling of shale plasticity. Shale plasticity is a primary factor in determining whether geology and drilling conditions are likely to cause balling of a drill bit, as the drill bit is drilling a borehole. Knowledge of such geology and drilling conditions can influence choice of bit design features, drilling fluid type or additives, and operating hydraulics. In essence, the method and apparatus of the present embodiment provide a measure of shale "stickyness" or plasticity. Plastic shales can have a significant impact on drilling costs. If plastic shale intervals can be identified at the well planning phase, then appropriate measures and/or actions can be taken to minimize the impact of such intervals on drilling efficiency. Such measures and/or actions may include (i) making cutting structure enhancements to the bit design; (ii) applying an electronegative coating to the body of the drill bit to repel sticky shales; (iii) modifying drilling fluid properties to stabilize the shales as much as possible; and (iv) modifying operating hydraulics to stabilize the shales as much as possible. The cost of drilling plastic shales with inappropriate drilling equipment has historically been quite significant, thus the present method and apparatus provide a potentially significant improvement over what is currently being done in the art.

No other comparable methods to evaluate shale plasticity are known in the art. The present embodiment advantageously provides a more accurate and comprehensive measure of shale plasticity than has been available in the industry to date. The present embodiment considers three (3)

key shale properties, which include volume, composition (shale type), and water content. In addition, the present embodiment provides a novel measure of shale plasticity based upon a weighted average of the three parameters.

According to the present embodiment, shale plasticity is modeled based upon the use of any well log that provides a measure of shale volume, shale type, or shale water content. For example, a measure of shale volume can be extracted from a gamma ray log or a neutron-density log using any of several industry standard methods. In addition, a co-pending application Ser. No. 08/970,171, filed Nov. 13, 1997, entitled "METHOD FOR QUANTIFYING THE LITHOLOGIC COMPOSITION OF FORMATIONS SURROUNDING EARTH BOREHOLES" and incorporated herein by reference, discloses a method to quantify lithologic component fractions, including shale volume.

A measure of shale type can be obtained in one of several ways. Shale or clay type can be evaluated using a thorium/potassium ratio from a spectral gamma ray log. The spectral gamma ray log provides a measure of the potassium, thorium and uranium content of a particular shale. Alternatively, shale or clay type can be determined from the cation exchange capacity (CEC) of the shale. CEC can be directly measured in a laboratory from chemical analysis of shale samples obtained from a wellbore. CEC can also be indirectly determined from gamma ray or neutron-density logs. The approach of determining clay type from the CEC of shale is less preferred since it is generally less accurate than the spectral gamma ray analysis However, CEC data, whether directly or indirectly measured, is generally more readily available than spectral gamma ray logs and therefore more likely to be utilized. Lastly, the water content of the shale can be derived from a nuclear magnetic resonance (NMR) log or a neutron-density log. NMR logs are preferred for greatest accuracy, however, neutron-density are generally more available.

As discussed, methods are known for performing the above analyses individually, i.e., for determining shale type, shale volume, and water content. However, a combined application of the above three distinct measures as discussed with respect to the following shale plasticity model is novel.

Plasticity Model

A first step in one embodiment of the present method is to identify any shale zones along a logged wellbore. If the clay content of a particular lithologic stratum exceeds 40%, then the stratum generally behaves as a shale. The characterization of clay content greater than 40% behaving as a shale is a well-known rule of thumb in the wellbore logging industry.

As mentioned earlier, shale volume can be extracted from either a gamma ray or a neutron-density log suite. A first criteria for evaluating shale plasticity is whether the shale content exceeds a threshold volume. Expressed in computer logic:

$$\text{IF } V_{sh} > V_{thresh} \text{ THEN Plastic Behavior Possible} \quad (1)$$

where:

$V_{sh}$ represents Shale volume; and $V_{thresh}$ represents Threshold shale volume (rule of thumb is 40% by volume).

A second step in the embodiment of the present method involves an identification of clay type or species. If a spectral gamma ray log is available, then the thorium/potassium ratio is evaluated as follows with reference to FIG. 1 for identifying clay type:

$$\text{IF } C_1 \leqq R > C_2 \text{ THEN Clay Type is ILLITE} \quad (2)$$

$$\text{IF } C_2 \leqq R \leqq C_3 \text{ THEN Clay Type is SMECTITE} \quad (3)$$

$$\text{IF } R \geqq C_3 \text{ THEN Clay Type is CHLORITE \& KAOLINITE} \quad (4)$$

where:

R represents the thorium/potassium ratio (typically thorium is measured in units of ppm and potassium in percent);

$C_1$ represents the lower limit of the thorium/potassium ratio for the clay type which is illite (typical value 0);

$C_2$ represents the upper limit of the thorium/potassium ratio for illite, which is also the lower limit for smectite (typical value 3); and $C_3$ represents the upper limit of the thorium/potassium ratio for smectite, which is also the lower limit for chlorite and kaolinite (typical value 12).

Figure 2:
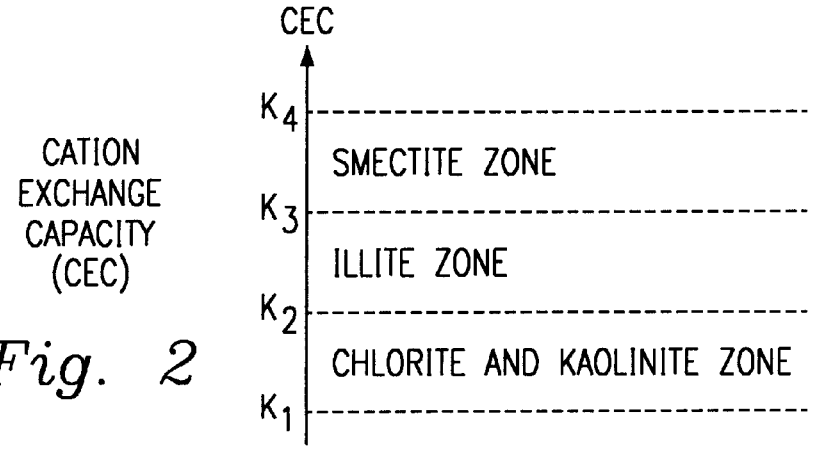
FIG. 2 illustrates a cation exchange capacity line having values for delineating various clay types by zones.

Alternatively, cation exchange capacity may be used to identify or determine clay type. As mentioned above, there are known methods in the art for deriving a measure of cation exchange capacity (CEC) from one of a variety of well logs including gamma ray and neutron-density. If CEC data is available, then criteria for identifying clay type becomes, with reference to FIG. 2:

$$\text{IF } K_1 \leqq CEC \leqq K_2 \text{ THEN Clay Type is CHLORITE \& KAOLINITE} \quad (5)$$

$$\text{IF } K_2 \leqq CEC \leqq K_3 \text{ THEN Clay Type is ILLITE} \quad (6)$$

$$\text{IF } CEC \geqq K_3 \text{ THEN Clay Type is SMECTITE} \quad (7)$$

where:

CEC is the cation exchange capacity (typically expressed in units of milliequivalents per gram);

$K_1$ is the lower limit of CEC for chlorite and kaolinite (typical value 0);

$K_2$ is the upper limit of CEC for chlorite and kaolinite, which is also the lower limit for illite (typical value 0.1); and $K_3$ is the upper limit of CEC for illite, which is also the lower limit for smectite (typical value 0.8)

In the wellbore drilling industry, it is well known that the smectites, which include montmorillonite, are the clay species most likely to cause plastic behavior in shales. This is primarily due to the highly laminated nature of the clay platelets of smectites. Trapped water between the clay platelets can cause significant swelling of the clay structure.

A second key criteria for evaluating shale plasticity is smectite content. Expressed in computer logic:

$$\text{IF CLAY TYPE=SMECTITE THEN Plastic Behavior Possible} \quad (8)$$

A third step in the embodiment of the present method involves measurement of the clay water content. Clay water content refers to the water trapped between the clay platelets and is often termed clay-bound water. The clay water content parameter can be derived from any of several well logs, including nuclear magnetic resonance (NMR) and neutron-density. The NMR log is generally preferred because of its greater accuracy over other logs. Clay-bound water is also equivalent to the shale porosity, since it is generally assumed that all pore space within the shale is occupied by water.

Figure 3:
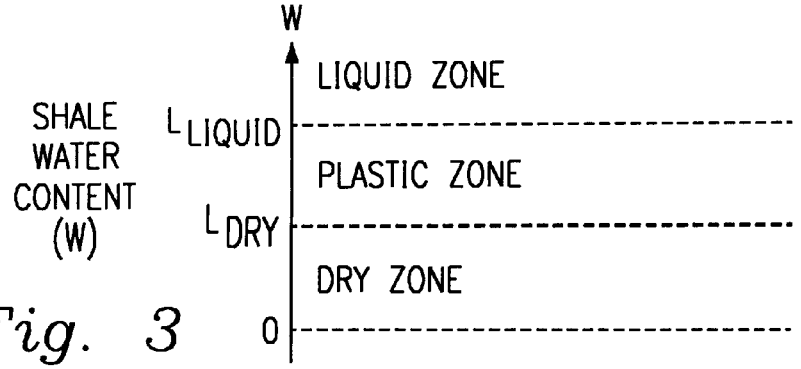
FIG. 3 illustrates a shale water content line having values for delineating various shale water contents by zones.

With respect to the third step, if the water content is low, then the shale will be too dry to be plastic. Likewise, if the water content is high, then the clay platelets generally can become dispersed to the point where the shale behaves essentially as a liquid. In the situation where the shale behaves essentially as a liquid, plastic behavior is made unlikely. However, there is an intermediate zone where the shale becomes "sticky", or plastic (FIG. 3). It is in this intermediate zone that the shale is quite likely to cause problems, such as bit balling. The intermediate zone is thus a third criteria for evaluating shale plasticity. Expressed in computer logic:

$$\text{IF } W \leqq L_{dry} \text{ THEN Shale is in a Dry Zone} \quad (9)$$

$$\text{IF } L_{dry} \leqq W \leqq L_{liquid} \text{ THEN Shale is in a Plastic Zone} \quad (10)$$

$$\text{IF } L_{liquid} \leqq W \text{ THEN Shale is in a Liquid Zone} \quad (11)$$

where:

W is a measure of shale water content or porosity (typically expressed as a volume percent);

$L_{dry}$ is an upper limit of water content for shale dry zone, which is also the lower limit for the shale plastic zone (value varies depending on geological location); and $L_{liquid}$ is an upper limit of water content for shale plastic zone, which is also the lower limit for the shale liquid zone (value varies depending on geologic location).

With respect to the shale water content, the shale behavior transition points, $L_{dry}$ and $L_{liquid}$, can be measured or inferred. That is, the transition points can be measured or inferred from laboratory analysis of shale cuttings taken from prior wells or from a shale shaker while drilling. With respect to the shale shaker, it is essentially a device having a vibrating screen for sifting out rock cuttings from drilling mud obtained while drilling a borehole.

In accordance with the present method, the following three criteria must be met simultaneously for the shale to behave in a plastic manner:

SHALE VOLUME IS GREATER THAN A THRESHOLD VALUE (12)

SHALE TYPE IS SMECTITE (13)

SHALE WATER CONTENT IS IN A PLASTIC ZONE (14)

Figure 4:
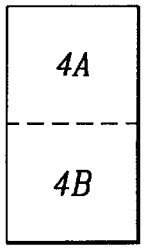
FIGS. 4A & 4B illustrates a shale plasticity model flow chart according to one embodiment of the present method.
Figure 4A:
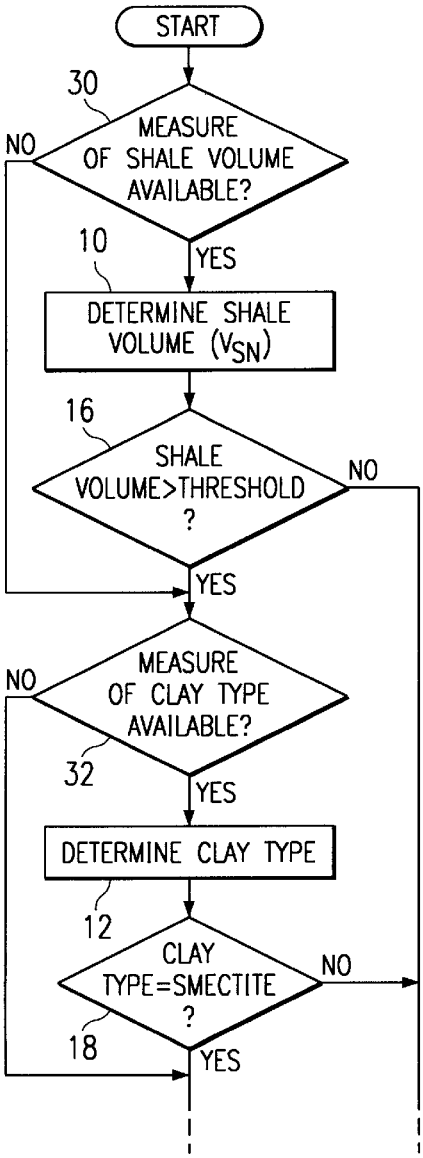
Figure 4B:
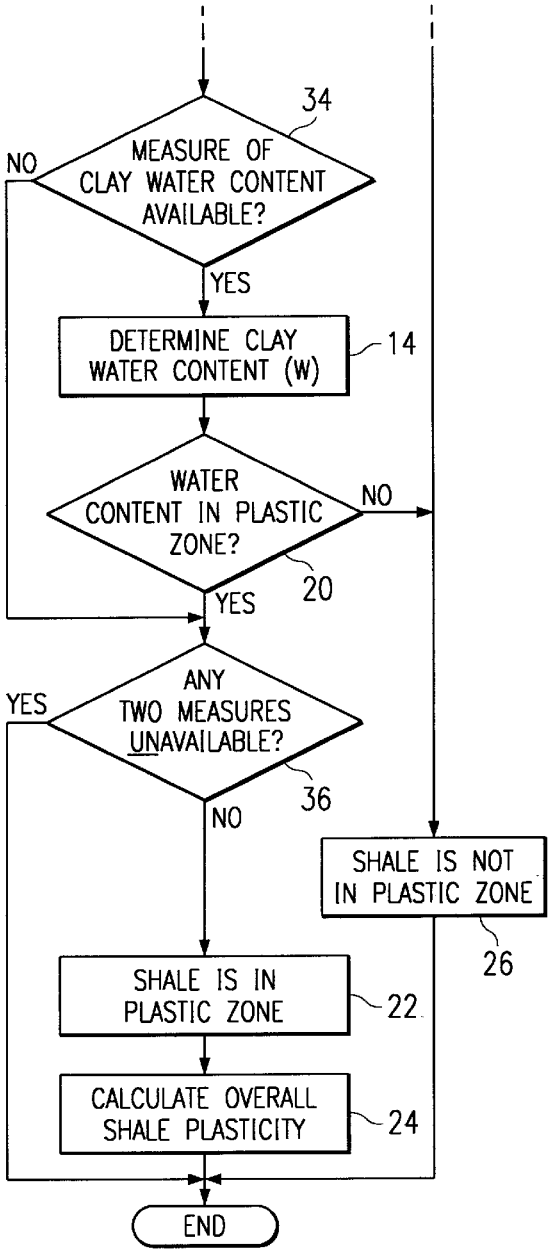

Referring now to FIG. 4, a plasticity model process flowchart is shown. If any one of the above criteria is not met for a particular shale at a particular geology and drilling condition, then the shale is not likely to be plastic.

A final step in the embodiment of the present method is to provide a single measure of overall shale plasticity. The single measure of overall shale plasticity can be achieved by taking a weighted average of the above three parameters (i.e., shale volume, clay type, and shale water content). Weighting factors are used to bias the average towards those parameters that exert a greater influence on shale plasticity in a given geology.

In order to determine the relative influence of each parameter on an overall shale plasticity measurement, the relevant data ranges of each parameter are normalized. In this manner, the influence of each parameter on overall plasticity then becomes more apparent. The weighting factors can be suitably calibrated, for example, by comparing the shale plasticity predicted from well logs to that measured by chemical analysis in a laboratory.

EXAMPLE

For further understanding, a numerical example is provided herein, to help further clarify the method of the present embodiment. It should be understood that the specific numbers used in the following example are for illustration purposes only. Other examples are possible.

First, shale volume is truncated to a desired range of interest, for example, 40% to 100% inclusive. All shale volumes less than 40% are converted to zero. This truncation isolates the range of shale volume where plastic behavior could occur. The remaining nonzero data is then normalized from 0 to 100%, or alternatively from 0 to 1, which is the fractional equivalent. For example, the normalization could be performed as follows:

$$y = x/(UL - LL) \quad (15)$$

where:

x is the truncated data, in this case shale volume;

y is the normalized data that lies within the plastic range, in this case shale volume;

UL is the upper limit of plastic region, in this case 1.0 (equivalent to 100%); and LL is the lower limit of plastic region, in this case 0.4 (equivalent to 40%).

A similar process is then performed on the remaining two parameters. However, there is one subtle difference. With shale volume, plasticity is greatest at maximum shale volume. This is also true for clay type from CEC logs. However, with clay water content and clay type from the spectral gamma ray log, maximum shale plasticity occurs within the midrange of the data rather than at the maximum value of the range. Therefore, these two latter parameters must be normalized with respect to the point where maximum shale plasticity occurs. The maximum shale plasticity point can be measured in a laboratory or estimated from experience with a given geology.

If determining clay type using CEC derived from well logs, then the data range is truncated and normalized in the same fashion as for the shale volume. Specifically, CEC values can be truncated to a desired range of interest, for example, 0.8 to 1.5 inclusive. All CEC values less than 0.8 are converted to zero. This truncation isolates the range of CEC values where plastic behavior could occur. The remaining nonzero data is then normalized in a similar fashion as that for the shale volume.

If determining clay type from the spectral gamma ray log, then the range of the thorium/potassium ratio can be truncated to a desired range of interest, for example, 3.7 to 12 inclusive. All values above and below the desired range are converted to zero. This truncation isolates the range of the thorium/potassium ratio where plastic behavior could occur. The remaining nonzero data is then normalized ($R_{n1}$). For instance, $R_{n1}$ is first normalized according to the normalization as illustrated in equation 15. However, maximum shale plasticity generally occurs within the midrange rather than at the maximum value of the range. Thus, the normalization is performed again with respect to the point where maximum shale plasticity occurs ($R_{n2}$). Expressed in computer logic, the clay type normalization ($R_{n2}$) may be accomplished as follows:

IF $R_{n1} \leqq M$ THEN $$R_{n2} = 1 - (M - R_{n1})/M \quad (16)$$

ELSE $$R_{n2} = (1 - R_{n1})/(1 - M) \quad (17)$$

ENDIF where:

$R_{n1}$ is the normalized thorium/potassium ratio (unitless with range from 0 to 1) with respect to the maximum value of the truncated data range;

$R_{n2}$ is $R_{m1}$ normalized with respect to a reference value M; and

M is the reference point where maximum shale plasticity occurs (unitless with typical range from 0.3 to 0.7).

Alternatively, the above described normalization of clay type can be accomplished using a single, mathematically equivalent normalization operation.

Finally, for the clay water content, the range of porosity values is truncated to a desired range of interest, for example, 0.1 to 0.2 inclusive. All values above and below the truncated range of interest are converted to zero. This truncation isolates the range of porosity values where plastic behavior could occur. The remaining data is then normalized ($W_{n1}$). For instance, $W_{n1}$ is first normalized according to the normalization as illustrated in equation 15. However, maximum shale plasticity generally occurs within the midrange rather than at the maximum value of the range. Thus, the normalization is performed again with respect to the point where maximum shale plasticity occurs ($W_{n2}$). Expressed in computer logic, normalization for clay water content ($W_{n2}$) may be accomplished in a similar fashion as for the thorium/potassium ratio as follows:

IF $W_{n1} \leqq M$ THEN $$W_{n2}=1-(M-W_{n1})/M \tag{18}$$

ELSE $$W_{n2}=(1-W_{n1})/(1-M) \tag{19}$$

ENDIF where:

$W_{n1}$ is the normalized clay water content or porosity (unitless with range from 0 to 1) normalized with respect to the maximum value of the truncated data range;

$W_{n2}$ is $W_{n1}$ normalized with respect to a reference value M; and

M is the reference point where maximum shale plasticity occurs (unitless with typical range from 0.3 to 0.7).

Alternatively, the above described normalization of clay water content can be accomplished using a single, mathematically equivalent normalization operation.

Now that the relevant data ranges for each of the three critical parameters have been isolated and normalized for the given example, a measure of overall shale plasticity can now be derived. First, if any of the three parameters has a value of zero as a result of the above normalization process, then the overall shale plasticity is set to zero. This would reflect the fact that one or more of the key conditions required for plasticity to occur has not been met. For this example, suppose that clay type is taken from a spectral gamma ray log. Expressed using computer logic:

IF ($V_{shn}$=0) OR ($R_n$=0) OR ($W_n$=0) THEN $$P=0 \tag{20}$$

ENDIF where:

$V_{shn}$ is the normalized shale volume (unitless with range from 0 to 1); and

P is the shale plasticity (unitless with valid range from 0 to 1).

Alternatively, if CEC data had been used instead of a spectral gamma ray log, then CEC would be substituted for the normalized thorium/potassium ratio, $R_n$, in equation 20.

Finally, an overall shale plasticity is further calculated as follows:

$$P=(nV^a_{shn}+n_2R^b_n+n_3W^c_n)/(n_1+n_2+n_3) \tag{21}$$

where:

$n_1$ is the weighting factor for normalized shale volume (valid range 0 to 1);

$n_2$ is the weighting factor for normalized thorium/potassium ratio (valid range 0 to 1);

$n_3$ is the weighting factor for normalized clay porosity (valid range 0 to 1);

a is an exponent for normalized shale volume (typical range 0.2–0.7);

b is an exponent for normalized thorium/potassium ratio (typical range near 1); and c is an exponent for normalized clay porosity (typical range near 1).

It should be noted that the exponent "a" applied to the normalized shale volume typically has a low value. This low value is due to the fact that as the shale volume increases above 40%, the rock composition rapidly approaches the behavior of pure shale.

Although there are other mathematical averaging techniques that could be applied for use in the modeling of shale plasticity, the underlying principle would remain the same. Any averaging method would provide a relative indication of shale plasticity. For instance, in equation 21, the denominator could be replaced by the numerical value three (3) to yield a standard arithmetic average. However, the previous above described averaging method is preferred because the individual contribution of each of the three critical parameters to overall shale plasticity can be modeled more accurately.

Alternate and equivalent methods include the following. Any data source that can provide a measure of clay volume, clay species or type, and water content could be utilized by the embodiment of the present method and apparatus. In the preferred embodiment, wireline or measurement while drilling (MWD) well logs are the preferred data source. Also, other averaging techniques could be used, for example, in lieu of equation 21, to provide a shale plasticity indicator in a manner as described herein. The method could also conceivably be applied by considering any two (2) of the above three shale parameters. Finally, any combination of any two (2) of the above shale parameters would yield a simpler plasticity model. That is, the simpler plasticity model could be achieved by setting one of the weighting factors in equation 21 to zero. However, the simpler plasticity model approach would not be as complete or as accurate as considering the effects of all three parameters together. Nevertheless, the simpler approach might be necessary if one of the required data streams is unavailable at such time as an indication of shale plasticity is needed.

The present method shall now be further discussed with reference to the flowchart of FIG. 4. As discussed above, the method includes three main steps which include determining a shale volume ($V_{sh}$) in step 10, determining a clay type in step 12, and determining clay water content (W) in step 14. Upon an occurrence of the shale volume being greater than a prescribed threshold (step 16), the clay type being smectite (step 18), and clay water content being in the plastic zone (step 20), then the shale is determined to be in the plastic zone (step 22). Upon a determination that the shale is in the plastic zone, then in step 24, an overall shale plasticity is calculated as discussed herein with respect to equation 21. Alternatively, if the shale volume is less than the prescribed threshold (step 16), or the clay type is other than smectite (step 18), or the water content is other than in the plastic zone (step 20), then the shale is not in the plastic zone (step 26).

In step 16, a suitable comparator compares a parameter representative of the shale volume to a parameter representative of the prescribed threshold. If the shale volume is greater than the threshold, then the process advances to the next step, tending towards the shale being in the plastic zone. Alternatively, if in step 16, the shale volume is determined to be less than the threshold, then the process advances to step 26, indicative of the shale not being in the plastic zone.

In step 18, a suitable comparator compares a parameter representative of the clay type with a parameter representative of smectite. If the clay type equals smectite, then the process advances to the next step, tending towards the shale being in the plastic zone. Alternatively, if in step 18, the clay type is determined to be different from smectite, then the process advances to step 26, indicative of the shale not being in the plastic zone.

In step 20, a suitable comparator compares a parameter representative of the clay water content with a parameter representative of water content in the plastic zone. If the clay water content equals the plastic zone water content, then the process advances to the next step, tending towards the shale being in the plastic zone. Alternatively, if in step 20 the clay water content is determined to be different from the plastic zone water content, then the process advances to step 26, indicative of the shale not being in the plastic zone.

Upon the determination that the shale is in the plastic zone in step 22, the process continues with a calculation of the overall shale plasticity in step 24. Any suitable calculating and/or computing device or apparatus may be used for performing the calculation of the overall shale plasticity, further according to the method as discussed herein above with respect to equation 21. The calculated overall shale plasticity may be represented by a suitable parameter, for example, wherein the parameter includes an output signal or parameter value. In one embodiment, such an overall shale plasticity parameter can be used for controlling a drilling operation, wherein the parameter provides an indication of potential bit balling problems in the drilling of a wellbore. In such an instance, corrective action may be taken in advance as may appropriate to minimize any potential adverse effects, such as bit failure or drilling down time, that can result in the event of a bit balling problem. The shale plasticity parameter may also be used for providing an early warning indication of a potential bit balling situation during a real time drilling operation. Alternatively, the parameter may be used in assisting in the characterization of a given lithology in a particular drilling field, i.e., for use in the optimization of a given drilling program which includes more than one wellbore.

In a given drilling program situation, all desired measurements (i.e., shale volume, clay type, and clay water content) may not be readily available for various reasons. If all desired measurements are not available, then a determination of overall shale plasticity can be obtained according to an alternate embodiment of the present method as follows. Referring again to FIG. 4, according to the alternate embodiment of the present method, in step 30, a determination is made as to whether or not a measure of shale volume is available. If a measure of shale volume is available, then the process advances to step 10 for the determination of shale volume. If the measure of shale volume is not available, then the process proceeds to step 32. In step 32, a determination is made as to whether or not a measure of clay type is available. If a measure of clay type is available, then the process proceeds to step 12 for the determination of clay type. On the other hand, if in step 32 a measure of clay type is not available, then the process proceeds to step 34. In step 34, a determination is made whether or not a measure of clay water content is available. If a measure of clay content is available, then the process proceeds with step 14 for the determination of clay water content. Alternatively, if in step 34, the measure of clay water content is not available, then the process proceeds to step 36. Step 36 is a determination of whether any two (2) measures are unavailable. That is, if any two (2) measures are not available, then the process ends without a calculation of the overall shale plasticity. On the other hand, if at least two of the three measurements are available, then a calculation of shale plasticity can be obtained.

As mentioned above, the accuracy of the calculation of the shale plasticity is affected by the number of available measurements. That is, the calculation of the shale plasticity is most accurate when the measurements of shale volume, clay type, and clay water content are all available. Lesser accuracy is obtained otherwise.

The present embodiment thus provides a method for obtaining a measurement of overall shale plasticity for a given lithology of a particular geologic formation. With respect to the present method, identification of potential plastic shale zones within a given lithology is now readily available. In addition, such a measurement of overall shale plasticity can be very useful in predicting the occurrence of a bit balling situation in the drilling of a wellbore over an interval. Still further, a drilling operation in a particular drilling program may be modified, in response to a measurement of a given overall shale plasticity. That is, if a given overall shale plasticity is measured, thus indicative of a potential plastic shale zone, then the drilling operation may be modified, or corrective measures taken, in a manner most appropriate for the given situation. For example, modification of the drilling operation and/or corrective measures may include: (i) making cutting structure enhancements to the bit design, (ii) applying an electro-negative coating to the body of the drill bit to repel sticky shales; (iii) modifying drilling fluid properties to stabilize the shale as much as possible; (iv) modifying operating hydraulics to stabilize the shales as much as possible; and (v) other actions as may be appropriate for the particular situation. For example, another action may include selecting a more appropriate drilling bit for use in the plastic shale zone. Taking appropriate corrective action and/or modifying the drilling operation in advance of drilling through a plastic shale zone helps to avoid an undesired occurrence of a bit balling situation, which further advantageously avoids undesired drilling operation down time and associated additional costs. The disadvantage of drilling plastic shales with inappropriate drilling equipment can thus be advantageously circumvented with the current method, and apparatus, as described herein.

Figure 5:
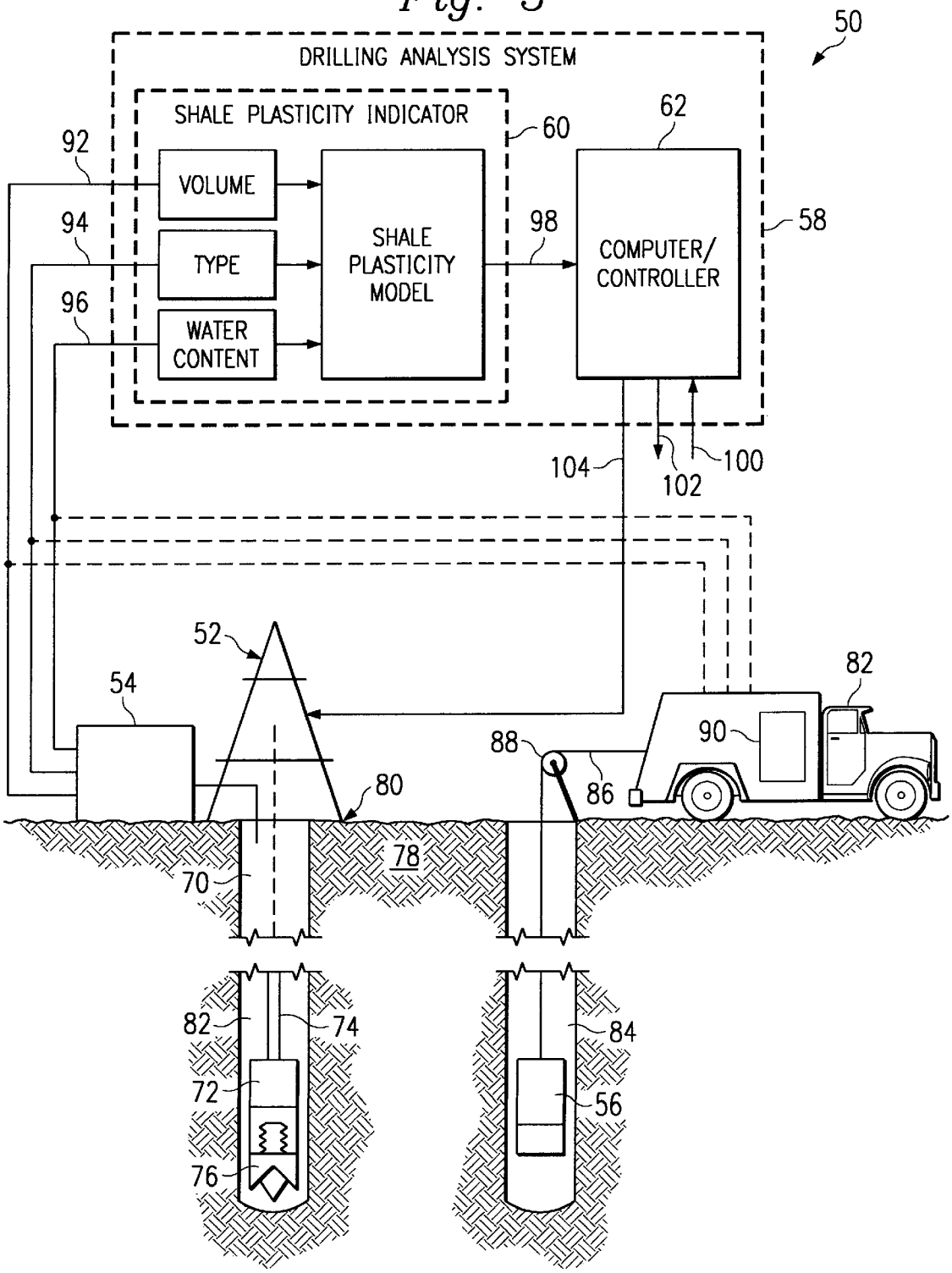
FIG. 5 illustrates a drilling operation and apparatus including a shale plasticity indicator according to another embodiment.

Turning now to FIG. 5, a drilling operation 50 is illustrated. The drilling operation 50 includes a drilling rig 52, measurement while drilling (MWD) instrumentation 54, and wireline measurement instrumentation 56. The drilling operation further includes a drilling analysis and control system 58. The drilling analysis and control system includes a shale plasticity indicator 60 and a computer/controller 62.

Drilling rig 52 is disposed atop a borehole 70. A logging tool or instrument 72 is carried on drilling string 74 disposed within the borehole 70. A drill bit 76 is located at the lower end of the drill string 74 and carves the borehole 70 through formations 78. During a drilling operation, drilling mud is pumped from a storage reservoir (not shown) near the wellhead 80, down an axial passageway (not shown) through the drill string 74, out of apertures (not shown) in the bit 76 and back to the surface through an annular region 82.

The logging tool or instrument 72 can include any conventional logging instrument such as acoustic (sometimes referred to as sonic), neutron, gamma ray, density, photoelectric, nuclear magnetic resonance, or any other conventional logging instrument, or combinations thereof, which can be used to measure lithology of formations surrounding an earth borehole.

In the instance of the logging instrument being embodied in the drill string 74 in FIG. 5, the system is referred to as a measurement while drilling (MWD) system. The MWD system logs data while a drilling process is underway. The logging data can be stored in a conventional downhole recorder (not shown), which can be accessed at the earth's surface when the drilling string is retrieved, or can be transmitted to the earth's surface using telemetry such as conventional mud pulse telemetry systems. In either event, logging data from the logging instrument 72 is relayed to the logging instrumentation 54 and drilling analysis system 58, to allow the data to be processed in accordance with the present method and apparatus.

Referring still to FIG. 5, a wireline logging truck 82, or the like, is situated at the surface of a wellbore 84. A wireline logging instrument 56 is suspended in the borehole by a logging cable 86 which passes over a depth measurement sleeve 88. As the logging instrument traverses the borehole 84, it logs the formations 78 surrounding the borehole 84 as a function of depth. The logging data is transmitted through the cable 86 to a surface data processor 90 located in or near the logging truck 82, further for processing the logging data in accord with the present method and apparatus as discussed herein. As with the MWD instrument, the wireline instrument may be any conventional logging instrument which can be used to measure the lithology of formations surrounding an earth borehole, such as acoustic, neutron, gamma ray, density, photoelectric, nuclear magnetic resonance, or any other conventional logging instrument, or combinations thereof, which can be used to measure lithology. Alternatively, logging data from the logging instrument 56 can be relayed to the drilling analysis system 58, to allow the data to be processed in accordance with the present method and apparatus.

Referring still to FIG. 5, logging data includes shale volume logging data on signal line 92, shale type logging data on signal line 94, and water content logging data on signal line 94. Signal lines 92, 94, and 96 are input to shale plasticity indicator 60. Shale plasticity indicator 60 includes any suitable means for performing the method of determining an overall shale plasticity measurement as discussed herein above. The shale plasticity indicator provides an output signal 98 representative of a measured overall shale plasticity parameter to computer/controller 62. Computer/controller 62 includes any suitable commercially available computer and/or controller having at least one input 100 for receiving input information and/or commands, for instance, from any suitable input device such as a keyboard, keypad, pointing device, or the like. Computer/controller 62 further includes at least one output 102 for outputting information and/or commands, for instance, to any suitable display device, monitor device, or the like. Still further, computer/controller 62 includes an output 104 for outputting information or commands, respectively, for use in controlling one or more various drilling operating parameters of drilling rig 52 in response to a shale plasticity measurement. Programming of computer/controller 62 may be done using known programming techniques for implementing the method as described herein. Thus, the drilling operation can be advantageously controlled in a prescribed manner to avoid drilling problems as discussed herein above, further associated with drilling through a plastic shale.

Distinct features of the present embodiments include the following. No other shale plasticity model is presently known which considers the three (3) key shale properties simultaneously or in the manner described above. As discussed, the three shale properties include clay volume, type and water content. The present method and apparatus therefore provide a more accurate measure of shale plasticity than is currently available.

While the invention has been particularly shown and described with reference to specific embodiments thereof, it will be understood by those skilled in the art that various changes in form and detail may be made thereto, and that other embodiments of the present invention beyond embodiments specifically described herein may be made or practice without departing from the spirit of the invention, as limited solely by the appended claims.

What is claimed is:

1. A method of quantifying shale plasticity for a given interval along a logged wellbore in a particular formation, said method comprising the steps of:

measuring at least two of the following selected from the group consisting of shale volume of the interval, shale composition of the interval, and shale water content of the interval; and producing a measurement of shale plasticity for the interval from at least two of the measurements of shale volume, shale composition, and shale water content according to a shale plasticity model.

2. The method of claim 1, wherein, measuring shale volume includes providing a shale volume parameter, measuring shale composition includes providing a shale composition parameter, and measuring shale water content includes providing a shale water content parameter.

3. The method of claim 1, wherein producing a measurement of shale plasticity from the measurements of shale volume, shale composition, and shale water content according to a shale plasticity model includes:

identifying a shale zone from the measured shale volume, the shale zone being characterized by a clay content greater than a prescribed threshold and indicative of possible plastic behavior;

identifying a shale type from the measured shale composition, the shale type being characterized by smectite and indicative of possible plastic behavior; and identifying the shale water content being characterized by a plastic zone and indicative of possible plastic behavior; and further producing a single measure of overall shale plasticity which includes a weighted average of the above three measured parameters using weighting factors, the weighting factors for biasing the average towards the parameters that exert a greater influence on shale plasticity in the formation.

4. The method of claim 3, wherein the shale plasticity is produced from shale volume, shale type, and shale water content measurements obtained from well logs associated with the wellbore, further comprising the step of:

calibrating the weighting factors by comparing the shale plasticity obtained from the well logs to a shale plasticity measured by a chemical analysis of shale samples taken from the wellbore.

5. The method of claim 1, wherein: measuring shale volume of the interval is accomplished by extracting shale volume from a well log selected from the group consisting of a gamma ray log, a spectral gamma ray log, and a neutron-density log.

6. The method of claim 1, wherein:

measuring shale composition of the interval is accomplished by a method selected from the group consisting of (i) using a thorium/potassium ratio obtained from a spectral gamma ray log, and (ii) using a cation exchange capacity (CEC), wherein CEC is determined using a method selected from the group consisting of (a) directly determined from chemical analysis of shale samples obtained from the wellbore, (b) indirectly determined from a gamma ray log, (c) indirectly determined from a spectral gamma ray log, and (d) indirectly determined from a neutron-density log.

7. The method of claim 1, wherein:

measuring shale water content of the interval is accomplished by extracting water content from a well log selected from the group consisting of a nuclear magnetic resonance log and a neutron-density log.

8. A method of quantifying shale plasticity in a geological formation, said method comprising the steps of:

measuring at least two of the following selected from the group consisting of shale volume of the formation, shale composition of the formation, and shale water content of the formation; and determining a measure of shale plasticity of the formation in response to at least two of the measured shale volume, shale composition, and shale water content according to a shale plasticity model.

9. The method of claim 8, wherein measuring the shale volume includes extracting a measure of shale volume from a well log selected from the group consisting of a gamma ray log, a spectral gamma ray log, and a neutron-density log.

10. The method of claim 8, wherein measuring shale composition includes obtaining a measure of shale composition by a method selected from the group consisting of (i) using a thorium/potassium ratio obtained from a spectral gamma ray log, and (ii) using a cation exchange capacity (CEC), wherein CEC is determined using a method selected from the group consisting of (a) directly determined from chemical analysis of one or more shale samples obtained from the formation, (b) indirectly determined from a gamma ray log, (c) indirectly determined from a spectral gamma ray log, and (d) indirectly determined from a neutron-density log.

11. The method of claim 8, wherein measuring the shale water content includes extracting a measure of water content from a well log selected from the group consisting of a nuclear magnetic resonance log and a neutron-density log.

12. The method of claim 8, wherein determining the measure of shale plasticity from the measurements of shale volume, shale composition, and shale water content according to the shale plasticity model includes:

identifying a shale zone from the measured shale volume, the shale zone being characterized by a clay content greater than a prescribed threshold and indicative of possible plastic behavior;

identifying a shale type from the measured shale composition, the shale type being characterized by smectite and indicative of possible plastic behavior; and identifying the shale water content being characterized by a plastic zone and indicative of possible plastic behavior.

13. The method of claim 12, wherein determining the measure of shale plasticity includes taking a weighted average of three parameters representative of the shale zone, shale type, and shale water content using weighting factors, the weighting factors for biasing the average towards the parameters that exert a greater influence on shale plasticity in the formation.

14. The method of claim 13, further comprising the step of:

calibrating the weighting factors by comparing the shale plasticity measure determined from the shale plasticity model to a reference shale plasticity measured using a chemical analysis of shale samples taken from the geological formation.

15. The method of claim 12, further comprising the steps of:

truncating shale volume values to a desired range where plastic behavior could occur, and then normalizing any non-zero shale volume values with respect to a given shale volume value where a maximum shale plasticity can occur, wherein the shale plasticity is a maximum at the maximum shale volume value of the range;

truncating shale type values to a desired range where plastic behavior could occur, and then normalizing any non-zero shale type values with respect to a given shale type value where a maximum shale plasticity can occur, wherein the shale plasticity is a maximum within a midrange to a maximum value of the shale type values of the range; and truncating shale water content values to a desired range where plastic behavior could occur, and then normalizing any non-zero shale water content values with respect to a given shale water content value where a maximum shale plasticity can occur, wherein the shale plasticity is a maximum within a midrange of the shale water content values of the range.

16. The method of claim 15, wherein the shale plasticity P is calculated according to the expression:

$$P=(n_1V^a_{shn}+n_2R^b_n+n_3W^c_n)/(n_1+n_2+n_3), \text{ where:}$$

$n_1$ is the weighting factor for normalized shale volume $V_{shn}$, having a valid range from 0 to 1;

$n_2$ is the weighting factor for normalized shale type $R_n$, having a valid range from 0 to 1;

$n_3$ is the weighting factor for normalized clay water content $W_n$, having a valid range from 0 to 1;

a is an exponent for the normalized shale volume, having a typical range of between 0.2–0.7;

b is an exponent for the normalized shale type, having a typical value near 1; and c is an exponent for the normalized clay water content, having a typical value near 1.

17. The method of claim 16, wherein the denominator $(n_1+n_2+n_3)$ is replaced by a numerical value of three (3) to yield an arithmetic average.

18. The method of claim 8, wherein the measures of shale volume, shale type, and shale water content are derived from well logs of a logged wellbore.

19. An apparatus for quantifying shale plasticity in a geological formation comprising:

means for measuring at least two of the following selected from the group consisting of shale volume of the formation, shale composition of the formation, shale water content of the formation; and means for determining a measure of shale plasticity of the formation in response to at least two of the measured shale volume, shale composition, and shale water content according to a shale plasticity model.

20. The apparatus of claim 19, wherein said means for measuring the shale volume includes means for extracting a measure of shale volume from a well log selected from the group consisting of a gamma ray log, a spectral gamma ray log, and a neutron-density log.

21. The apparatus of claim 19, wherein said means for measuring shale composition includes means for extracting a measure of shale composition with the use of one of the following selected from the group consisting of (i) a thorium/potassium ratio obtained from a spectral gamma ray log, and (ii) using a cation exchange capacity (CEC), wherein CEC is determined from one of the following selected from the group consisting of (a) directly determined from chemical analysis of one or more shale samples obtained from the formation, (b) indirectly determined from a gamma ray log, (c) indirectly determined from a spectral gamma ray log, and (d) indirectly determined from a neutron-density log.

22. The apparatus of claim 19, wherein said means for measuring shale water content includes means for extracting a measure of water content from a well log selected from the group consisting of a nuclear magnetic resonance log and a neutron-density log.

23. The apparatus of claim 19, wherein said means for determining the measure of shale plasticity according to the shale plasticity model includes:

means for identifying a shale zone from the measured shale volume, the shale zone being characterized by a clay content greater than a prescribed threshold and indicative of possible plastic behavior;

means for identifying a shale type from the measured shale composition, the shale type being characterized by smectite and indicative of possible plastic behavior; and means for identifying the shale water content being characterized by a plastic zone and indicative of possible plastic behavior.

24. The apparatus of claim 23, wherein said means for determining the measure of shale plasticity includes means for taking a weighted average of three parameters representative of the shale zone, shale type, and shale water content using weighting factors, the weighting factors for biasing the average towards the parameters that exert a greater influence on shale plasticity in the formation.

25. The apparatus of claim 24, wherein the weighting factors calibrated by comparing the shale plasticity measure determined from the shale plasticity model to a reference shale plasticity measured using a chemical analysis of shale samples taken from the formation.

26. The apparatus of claim 23, further comprising:

means for truncating shale volume values to a desired range where plastic behavior could occur, and then normalizing any non-zero shale volume values with respect to a given shale volume value where a maximum shale plasticity can occur, wherein the shale plasticity is a maximum at the maximum shale volume value of the range;

means for truncating shale type values to a desired range where plastic behavior could occur, and then normalizing any non-zero shale type values with respect to a given shale type value where a maximum shale plasticity can occur, wherein the shale plasticity is a maximum within a midrange to a maximum value of the shale type values of the range; and means for truncating shale water content values to a desired range where plastic behavior could occur, and then normalizing any non-zero shale water content values with respect to a given shale water content value where a maximum shale plasticity can occur, wherein the shale plasticity is a maximum within a midrange of the shale water content values of the range.

27. The apparatus of claim 26, wherein the shale plasticity P is calculated according to the expression:

$$P=(n_1V^a_{shn}+n_2R^b_n+n_3W^c_n)/(n_1+n_2+n_3), \text{ where:}$$

$n_1$ is the weighting factor for normalized shale volume $V_{shn}$, having a valid range from 0 to 1;

$n_2$ is the weighting factor for normalized shale type $R_n$, having a valid range from 0 to 1;

$n_3$ is the weighting factor for normalized clay water content $W_n$, having a valid range from 0 to 1;

a is an exponent for the normalized shale volume, having a typical range of between 0.2–0.7;

b is an exponent for the normalized shale type, having a typical value near 1; and c is an exponent for the normalized clay water content, having a typical value near 1.

28. The apparatus of claim 27, wherein the denominator $(n_1+n_2+n_3)$ is replaced by a numerical value of three (3) to yield an arithmetic average.

29. The apparatus of claim 19, wherein the measures of shale volume, shale type, and shale water content are derived from well logs of a logged wellbore.

30. A drilling system for drilling a wellbore in a formation according to a particular drilling process, said drilling system comprising:

a drilling rig;

measurement means for providing a measure of shale plasticity along a wellbore;

control means responsive to the measure of shale plasticity for controlling the drilling process with said drilling;

wherein said shale plasticity measurement means includes:

means for measuring at least two of the following selected from the group consisting of a shale volume of the formation, shale composition of the formation, and shale water content of the formation; and means for determining a measure of shale plasticity of the formation in response to at least two of the measured shale volume, shale composition, and shale water content according to a shale plasticity model.

31. The drilling system of claim 30, wherein said means for determining the measure of shale plasticity according to the shale plasticity model includes:

means for identifying a shale zone from the measured shale volume, the shale zone being characterized by a clay content greater than a prescribed threshold and indicative of possible plastic behavior;

means for identifying a shale type from the measured shale composition, the shale type being characterized by smectite and indicative of possible plastic behavior; and means for identifying the shale water content being characterized by a plastic zone and indicative of possible plastic behavior.

32. The drilling system of claim 31, wherein said means for determining the measure of shale plasticity includes means for taking a weighted average of three parameters representative of the shale zone, shale type, and shale water content using weighting factors, the weighting factors for biasing the average towards the parameters that exert a greater influence on shale plasticity in the formation.

33. The drilling system of claim 32, wherein the weighting factors are calibrated by comparing the shale plasticity measure determined from the shale plasticity model to a reference shale plasticity measured using a chemical analysis of shale samples taken from the formation.

34. A drilling system for drilling a wellbore in a formation according to a particular drilling process, said drilling system comprising:

a drilling rig;

measurement means for providing a measure of shale plasticity along a wellbore;

control means responsive to the measure of shale plasticity for controlling the drilling process with said drilling rig;

means for truncating shale volume values to a desired range where plastic behavior could occur, and then normalizing any non-zero shale volume values with respect to a given shale volume value where a maximum shale plasticity can occur, wherein the shale plasticity is a maximum at the maximum shale volume value of the range;

means for truncating shale type values to a desired range where plastic behavior could occur, and then normalizing any non-zero shale type values with respect to a given shale type value where a maximum shale plasticity can occur, wherein the shale plasticity is a maximum within a midrange to a maximum value of the shale type values of the range; and means for truncating shale water content values to a desired range where plastic behavior could occur, and then normalizing any non-zero shale water content values with respect to a given shale water content value where a maximum shale plasticity can occur, wherein the shale plasticity is a maximum within a midrange of the shale water content values of the range.

35. The drilling system of claim 34, wherein the shale plasticity P is calculated according to the expression:

$$P=(n_1V^a_{shn}+n_2R^b_n+n_3W^c_n)/(n_1+n_2+n_3),$$ where:

$n_1$ is the weighting factor for normalized shale volume $V_{shn}$, having a valid range from 0 to 1;

$n_2$ is the weighting factor for normalized shale type $R_n$, having a valid range from 0 to 1;

$n_3$ is the weighting factor for normalized clay water content $W_n$, having a valid range from 0 to 1;

a is an exponent for the normalized shale volume, having a typical range of between 0.2–0.7;

b is an exponent for the normalized shale type, having a typical value near 1; and c is an exponent for the normalized clay water content, having a typical value near 1.

36. The drilling system of claim 35, wherein the denominator $(n_1+n_2+n_3)$ is replaced by a numerical value of three (3) to yield an arithmetic average.

37. A drilling system for drilling a wellbore in a formation according to a particular drilling process, said drilling system comprising:

a drilling rig;

measurement means for providing a measure of shale plasticity alone a wellbore; and control means responsive to the measure of shale plasticity for controlling the drilling process with said drilling rig, wherein the measures of shale volume, shale type, and shale water content are derived from well logs of a logged wellbore.

* * * * *